US010911871B1

(12) United States Patent
Abel et al.

(10) Patent No.: US 10,911,871 B1
(45) Date of Patent: Feb. 2, 2021

(54) METHOD AND APPARATUS FOR ESTIMATING SPATIAL CONTENT OF SOUNDFIELD AT DESIRED LOCATION

(71) Applicants: Jonathan S. Abel, Menlo Park, CA (US); Agnieszka Roginska, Woodstock, NY (US)

(72) Inventors: Jonathan S. Abel, Menlo Park, CA (US); Agnieszka Roginska, Woodstock, NY (US)

( * ) Notice: Subject to any disclaimer, the term of this patent is extended or adjusted under 35 U.S.C. 154(b) by 0 days.

(21) Appl. No.: 15/435,211

(22) Filed: Feb. 16, 2017

Related U.S. Application Data

(62) Division of application No. 13/224,256, filed on Sep. 1, 2011, now Pat. No. 9,578,419.

(60) Provisional application No. 61/379,332, filed on Sep. 1, 2010.

(51) Int. Cl.

| | |
|---|---|
| ***H04R 5/027*** | (2006.01) |
| ***H04R 5/04*** | (2006.01) |
| ***H04R 3/00*** | (2006.01) |
| ***H04R 5/033*** | (2006.01) |

(52) U.S. Cl.
CPC ..... *H04R 5/027* (2013.01); *H04R 3/005* (2013.01); *H04R 5/033* (2013.01); *H04R 5/04* (2013.01)

(58) Field of Classification Search
CPC ..... H04R 3/005; H04R 5/027; H04R 5/033; H04R 5/04; H04R 1/1016; H04R 1/1041; H04R 2420/07; H04S 1/00; H04S 1/002; H04S 1/005; H04S 1/007; H04S 3/00; H04S 3/005; H04S 7/304; H04S 2400/01; H04S 2420/01
USPC .... 381/26, 74, 309, 310, 91, 92, 122, 1, 17, 381/18
See application file for complete search history.

(56) References Cited

U.S. PATENT DOCUMENTS

| | | | | |
|---|---|---|---|---|
| 6,016,473 | A * | 1/2000 | Dolby | G10L 19/008 704/500 |
| 6,507,658 | B1 | 1/2003 | Abel et al. | |
| 6,628,787 | B1 * | 9/2003 | McGrath | H04S 3/02 381/17 |
| 6,711,270 | B2 * | 3/2004 | Masuda | H04S 3/004 381/22 |
| 7,430,300 | B2 | 9/2008 | Vosburgh et al. | |
| 7,561,701 | B2 | 7/2009 | Fischer | |

(Continued)

OTHER PUBLICATIONS

Hur, Yoomi et al. "Microphone Array Synthetic Reconfiguration", Audio Engineering Society, Convention Paper, Presented at the 127th Convention, Oct. 9-12, 2009, 11 pages.

*Primary Examiner* — Xu Mei
(74) *Attorney, Agent, or Firm* — Foley & Lardner LLP

(57) ABSTRACT

In general, the present invention relates to a method and apparatus for estimating spatial content of a soundfield at a desired location, including a location that has actual sound content obstructed or distorted. According to certain aspects, the present invention aims at presenting a more natural, spatially accurate sound, for example to a user at the desired location who is wearing a helmet, mimicking the sound a user would experience if they were not wearing any head-gear. Modes for enhanced spatial hearing may be applied which would include situation-dependent processing for augmented hearing. According to other aspects, the present invention aims at remotely reproducing the soundfield at a desired location with faithful reproduction of the spatial content of the soundfield.

17 Claims, 5 Drawing Sheets

(56) References Cited

U.S. PATENT DOCUMENTS

| | | | | |
|---|---|---|---|---|
| 7,634,093 | B2 * | 12/2009 | McGrath | H04S 3/00 381/1 |
| 8,442,244 | B1 | 5/2013 | Long, Jr. | |
| 9,578,419 | B1 * | 2/2017 | Abel | H04R 5/027 |
| 2005/0259832 | A1 * | 11/2005 | Nakano | H04R 1/406 381/92 |
| 2008/0004872 | A1 * | 1/2008 | Nordholm | H04R 5/027 704/226 |
| 2012/0020485 | A1 | 1/2012 | Visser et al. | |
| 2014/0119552 | A1 * | 5/2014 | Beaucoup | H04M 9/082 381/66 |

* cited by examiner (A)

(B)

(C)

(D)

METHOD AND APPARATUS FOR ESTIMATING SPATIAL CONTENT OF SOUNDFIELD AT DESIRED LOCATION

CROSS-REFERENCE TO RELATED APPLICATIONS

The present application is a divisional of U.S. patent application Ser. No. 13/224,256, filed Sep. 1, 2011, now U.S. Pat. No. 9,578,419. The present application also claims priority to U.S. Provisional Appln. No. 61/379,332, the contents of all such applications being incorporated herein by reference in their entirety.

FIELD OF THE INVENTION

The present invention relates to audio signal processing, and more particularly to a method and apparatus for estimating spatial content of a soundfield at a desired location, including a location that has actual sound content obstructed or distorted.

BACKGROUND OF THE INVENTION

The spatial content of the soundfield provides an important component of one's situational awareness. However, when wearing a helmet, such as when playing football or hockey, or when riding a bicycle or motorcycle, sounds are muffled and spatial cues altered. As a result, a quarterback might not hear a lineman rushing from his "blind side," or a bike rider might not hear an approaching car.

Accordingly, a need remains in the art for a solution to these problems, among others.

SUMMARY OF THE INVENTION

The present invention relates to a method and apparatus for estimating spatial content of a soundfield at a desired location, including a location that has actual sound content obstructed or distorted. According to certain aspects, the present invention aims at presenting a more natural, spatially accurate sound, for example to a user at the desired location who is wearing a helmet, mimicking the sound a user would experience if they were not wearing any headgear. Modes for enhanced spatial hearing may be applied which would include situation-dependent processing for augmented hearing. According to other aspects, the present invention aims at remotely reproducing the soundfield at a desired location with faithful reproduction of the spatial content of the soundfield for entertainment purposes, among other things.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

Figure 1:
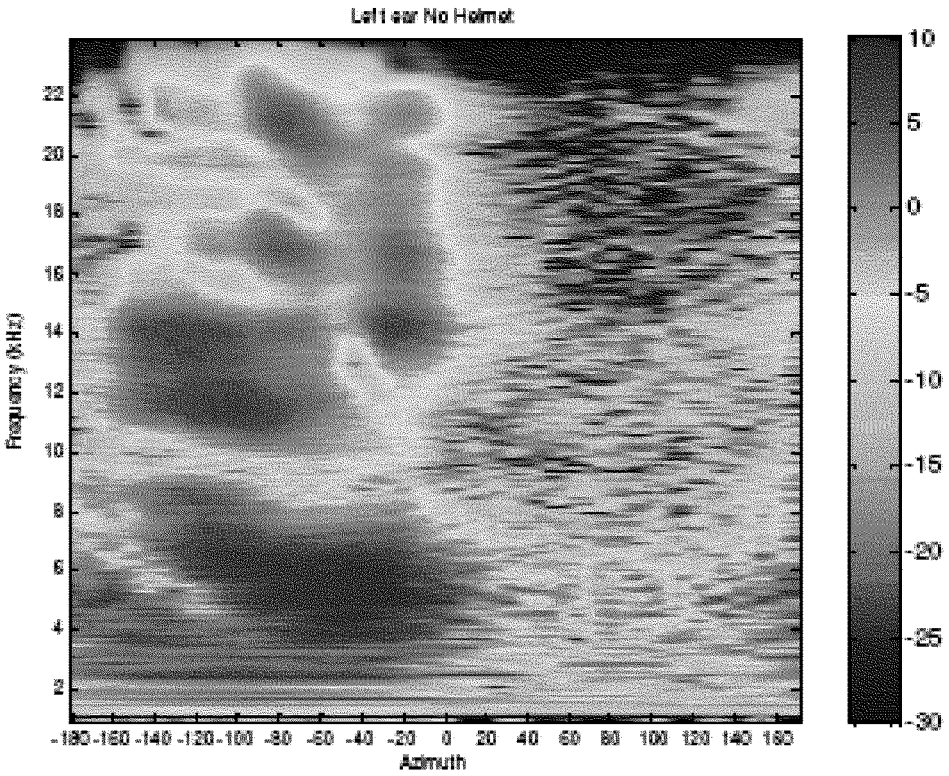
FIGS. 1A-1D illustrate effects of a helmet on perceived sound as a function of frequency and direction of arrival (e.g. azimuth)
Figure 1:
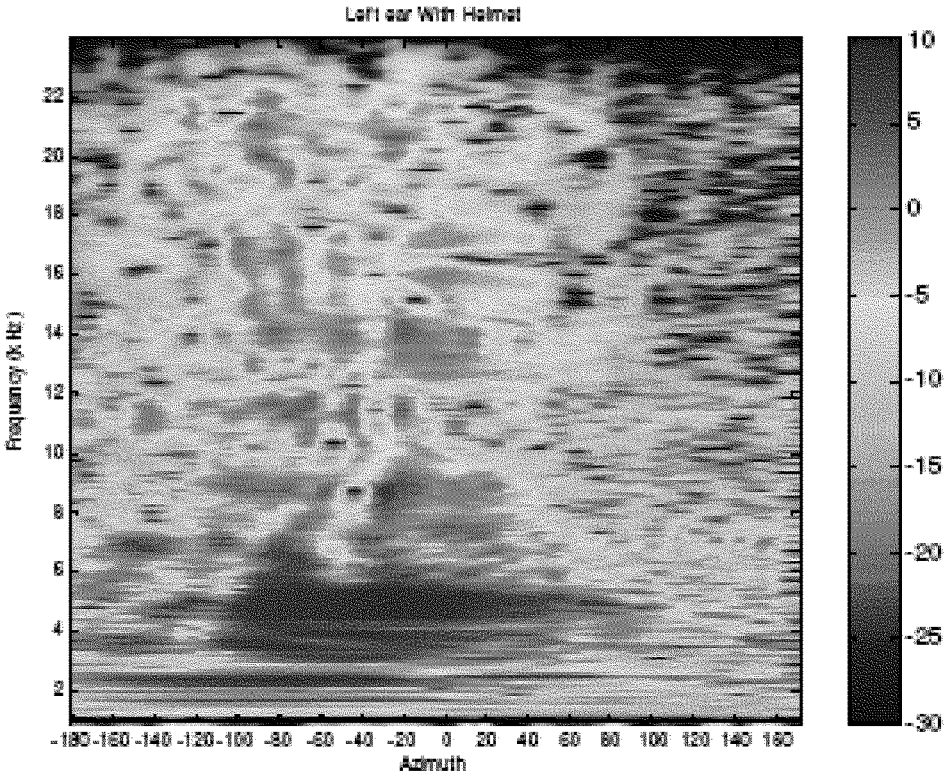
Figure 1:
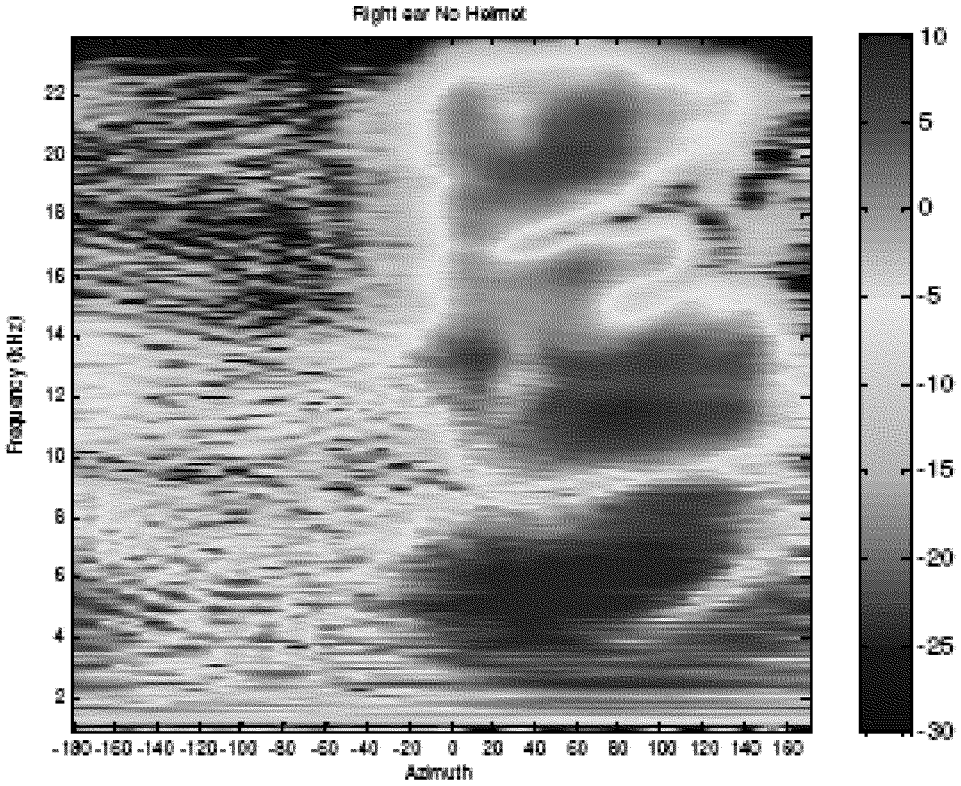
Figure 1:
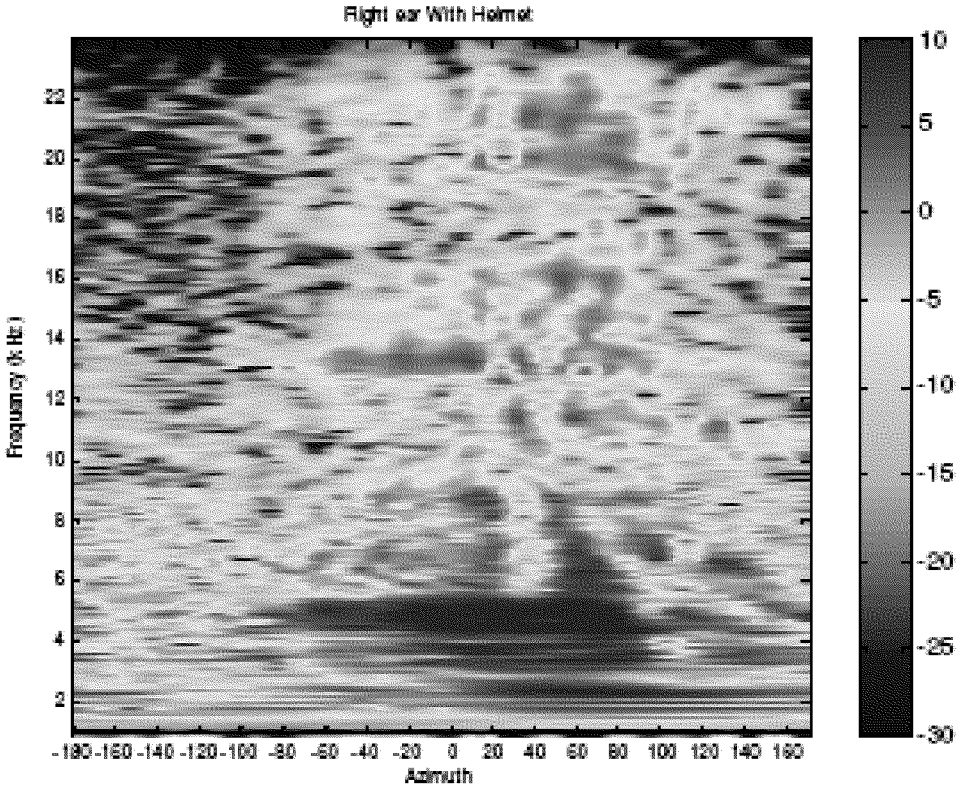

In some general aspects, the present invention recognizes that spatial content of a soundfield at a given location can become distorted and/or degraded, for example by headgear worn by a user at that location. This is illustrated in FIGS. 1A-1D. More particularly, FIGS. 1A and 1B compare the sound energy as a function of frequency and azimuth received in a left ear with and without a helmet, respectively. Similarly, FIGS. 1C and 1D compare the sound energy as a function of frequency and azimuth received in a right ear with and without a helmet, respectively.

To avoid these situations, the present invention incorporates microphones into helmets and hats (and even clothing, gear, balls, etc.) worn by sports participants and riders. The soundfield and its spatial character may then be captured, processed, and passed on to participants and perhaps also to fans. Restoring a player's or rider's natural spatial hearing cues enhances safety; providing spatialized communications among players augments gameplay; rendering a player's, referee's, or other participant's soundfield for fans provides an immersive entertainment experience.

According to some aspects, the invention aims at presenting a more natural, spatially accurate sound to a user wearing a helmet, mimicking the sound a user would experience if they were not wearing any headgear. Modes for enhanced spatial hearing may be applied which would include situation-dependent processing for augmented hearing.

Figure 2:
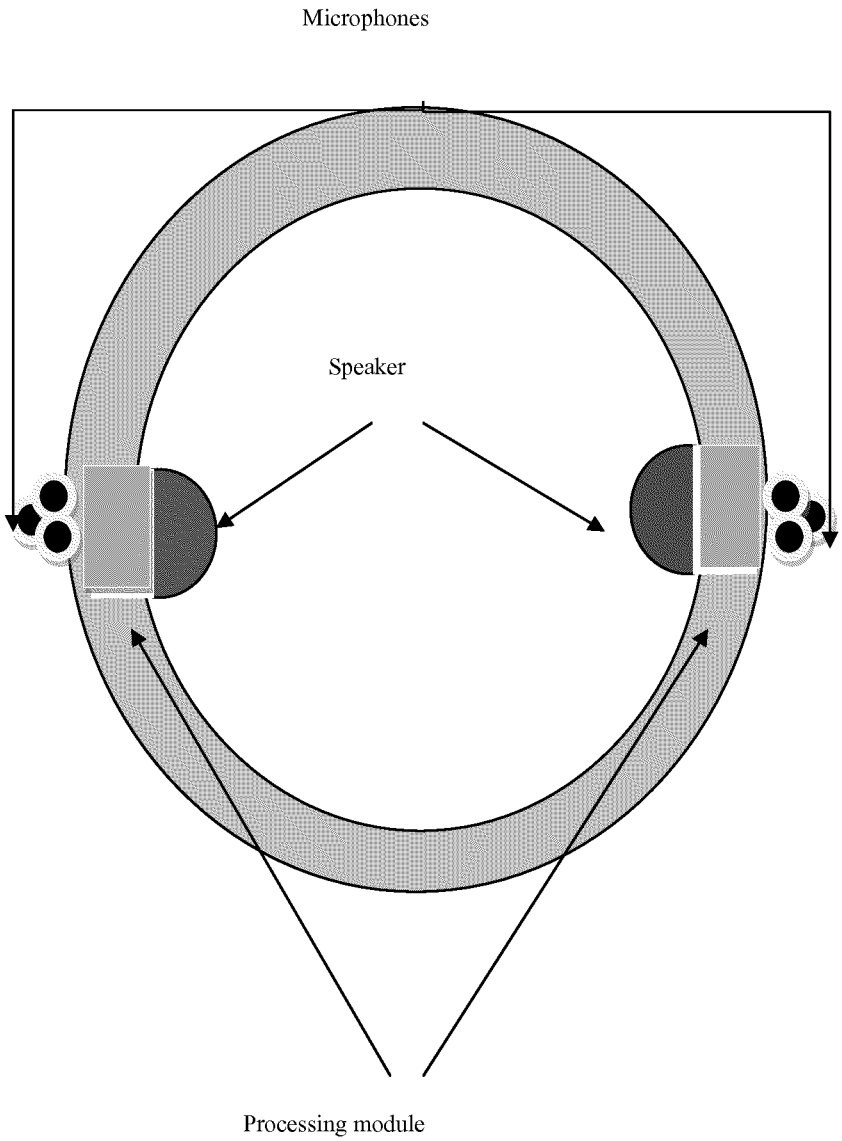
FIG. 2 illustrates an example headgear apparatus according to aspects of the invention.

In one embodiment shown in FIG. 2, an apparatus according to the invention consists of headgear (a helmet), which may or may not include a physical alteration (e.g. concha). The helmet includes at least one microphone and speaker. The microphone(s) are located on or around the outside of the helmet. The signal received by the microphone(s) may or may not be manipulated using digital signal processing methods, for example performed by processing module(s) built into the helmet. The processing module(s) can be an x86 or TMS320 DSP or similar processor and associated memory that is programmed with functionality described in more detail below, and those skilled in the art will understand such implementation details after being taught by the present examples.

Figure 3:
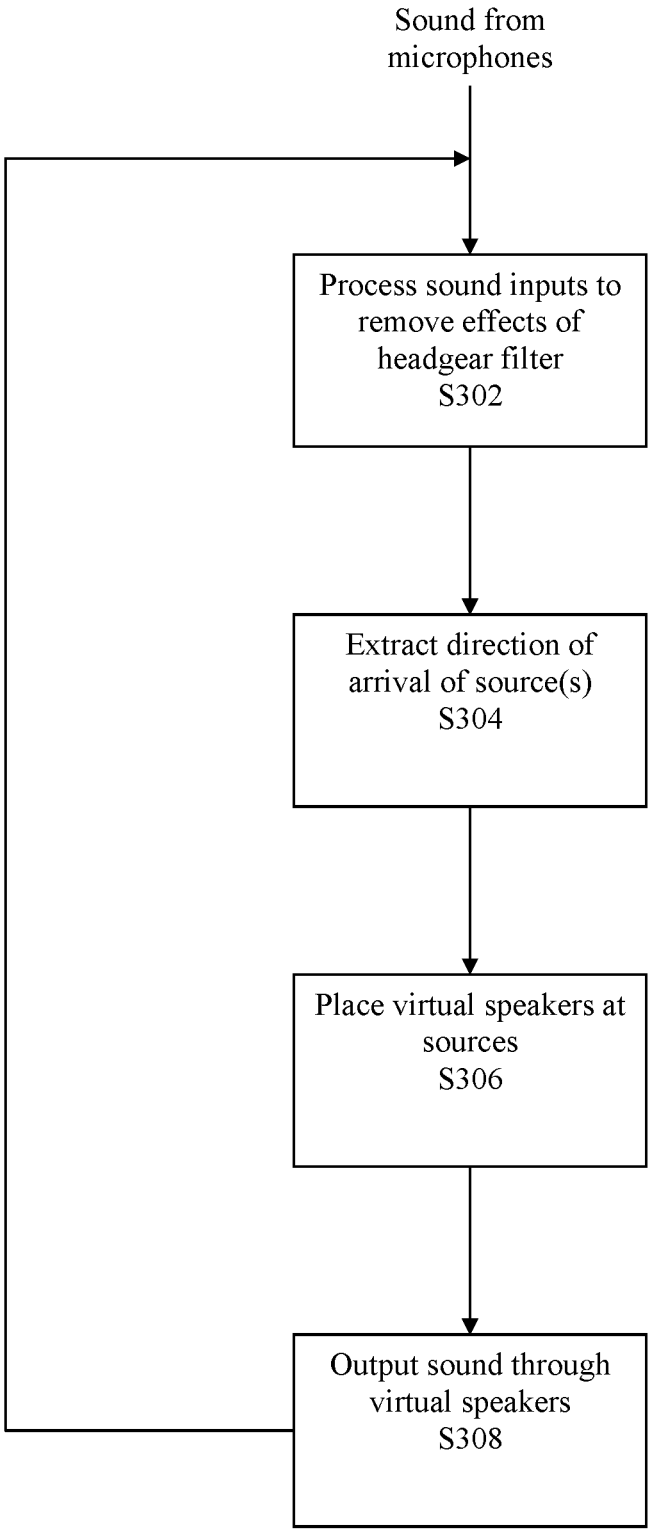
FIG. 3 illustrates an example method according to aspects of the invention.

An example methodology according to certain safety aspects of the invention is illustrated in FIG. 3.

As shown in FIG. 3, sound is received from two or more microphones, for example microphones on a helmet as shown in FIG. 2. Other examples are possible, for example, remote microphone(s) on a referee or camera. Other positioning inputs are also possible, such as inputs from an accelerometer, gyro or compass.

In step S302, the sound is processed (if necessary) to remove the effects of the headgear filter. Those skilled in the art will be able to understand how to implement an inverse filter based on a characterized filter such as the filter causing the distortion in FIGS. 1A to 1D.

In step S304, the un-filtered sound and/or positioning input(s) is further processed to extract the direction of arrival of sound source(s) in the inputs. There are many ways that this processing can be performed. For example, one or more techniques can be used as described in Y. Hur et al., "Microphone Array Synthetic Reconfiguration," AES Convention Paper presented at the 127$^{th}$ Convention, Oct. 9-12 2009, the contents of which are incorporated by reference herein.

In step S306, virtual speakers are placed at the determined position(s) of the identified source(s), and in step S308, sound is output from the virtual speakers. The output can be a conventional stereo (L/R) output, for example to be played back into real speakers on a helmet such as that shown in FIG. 2. The output can also be played back using a surround sound format, using techniques such as those described in U.S. Pat. No. 6,507,658, the contents of which are incorporated by reference herein.

Figure 4:
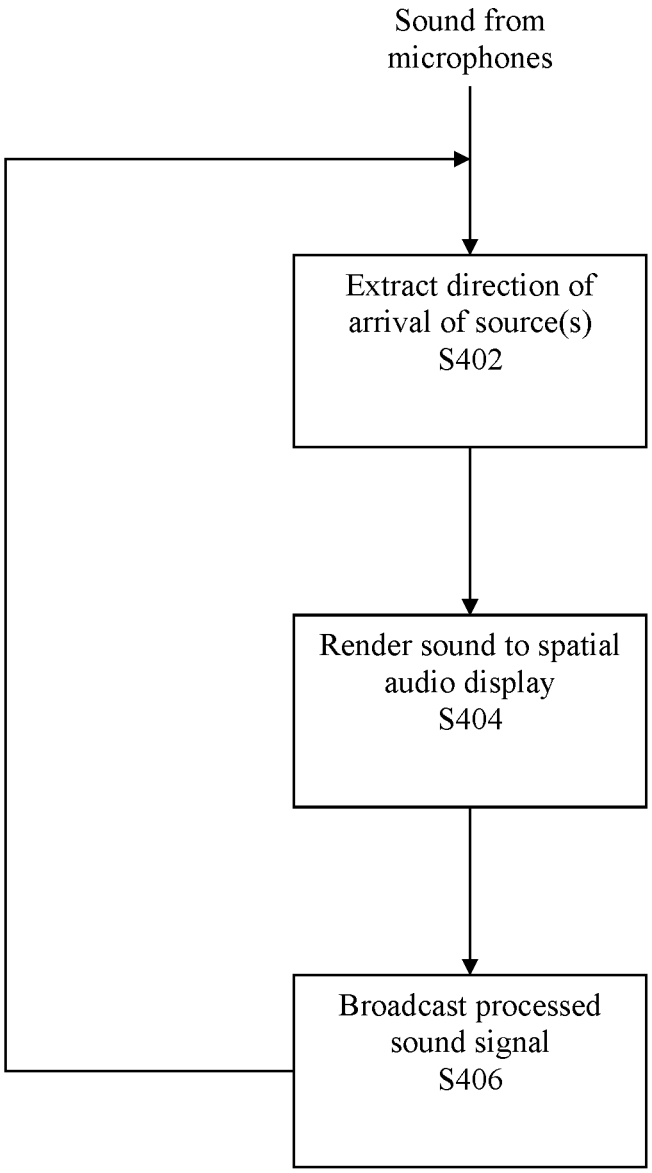
FIG. 4 illustrates another example method according to aspects of the invention.

An example methodology according to certain entertainment aspects of the invention is illustrated in FIG. 4.

As shown in FIG. 4, sound is received from two or more microphones, for example microphones on a helmet as shown in FIG. 2. Other examples are possible, for example, remote microphone(s) on a referee or camera. Other positioning inputs are also possible, such as inputs from an accelerometer, gyro or compass.

In step S402, the sound is processed to extract the direction of arrival of sound source(s) in the inputs. There are many ways that this processing can be performed. For example, one or more techniques can be used as described in Y. Hur et al., "Microphone Array Synthetic Reconfiguration," AES Convention Paper presented at the 127$^{th}$ Convention, Oct. 9-12 2009, the contents of which are incorporated by reference herein.

In one example implementation, the sound signal(s) received by the microphones are transmitted (e.g. via WiFi, RF, Bluetooth or other means) to a remotely located processor and further processing is performed remotely (e.g. in a gameday television or radio broadcast studio).

In step S404, the processed sound signal is rendered to a surround sound (e.g. 5.1, etc.) or other spatial audio display format, using techniques such as those described in U.S. Pat. No. 6,507,658, the contents of which are incorporated by reference herein.

It should be apparent that other processing can be performed before output, such as performing noise cancellation, and to separate, select and/or eliminate different sound sources (e.g. crowd noise, etc.).

In step S406, the rendered sound signal is broadcast (e.g. RF, TV, radio, satellite) for normal playback through any compatible surround sound system.

Embodiments of the invention can find many useful applications.

In Entertainment applications, for example, embodiments of the invention include: referee hats, player helmets, clothing, uniforms, gear, balls, "flying" and other cameras outfitted with single, multiple microphones, in-ear, in-ear with hat, helmet-mounted microphones combined with stadium, arena microphones (on down markers, goal posts, etc.); directional microphones, directional processing, raw signals; translation to specific playback systems and formats: e.g., broadcast formats surround, stereo speakers, (binaural) headphones; in-stadium fan, coaches displays; position, head orientation tracking; helmet modifications to enhance or restore altered spatial cues; wind, clothing noise suppression.

In Gameplay applications, for example, embodiments of the invention include: wind, clothing noise suppression; Communications between players with position encoded; stereo earphones, at least one microphone or synthesized signal; reverberation to cue distance rather than amplitude reduction; spatialized sonic icons, sonification indicating arrangement of certain own-team players or certain opponent players (possibly derived from video signals); offsides in hockey, e.g. referee signals for improved foul calls (e.g., hear punt, pass released, player crossing boundary such as the line of scrimmage); quarterback (microphone array, advanced helmet) enhanced amplification for sounds arising from the rear; suppressed out-of-plane sounds, enhanced in-plane signals (reduce crowd noise, noise suppression); player positioning, where you are on the field ("hear" the sidelines, auditory display for line of scrimmage e.g.); Example applications: football, hockey.

In Safety applications, for example, embodiments of the invention include: bicycle, motorcycle, sports helmets, hats, clothing, vehicle exterior; enhanced volume, sonic icons from rear, sides; amplification of actual soundfield, or synthesized sounds based on detecting the presence of an object via other means; arrival angle tracking for collision detection; Example applications: bike, snowboard, ski, skateboard helmet Although the present invention has been particularly described with reference to the preferred embodiments thereof, it should be readily apparent to those of ordinary skill in the art that changes and modifications in the form and details may be made without departing from the spirit and scope of the invention.

What is claimed is:

1. A method comprising:

receiving sound signals from two or more microphones associated with a listening location;

processing the received sound signals to determine a direction of arrival associated with a sound source of the received sound signals with respect to positions of the two or more microphones, wherein the processing includes determining spatial content of a soundfield surrounding the listening location as represented by sound energy as a function of direction across a range of at least 180 degrees of values of direction defined by the soundfield, and wherein the determined direction of arrival is at any of a plurality of different values of direction within the range of at least 180 degrees of values of direction defined by the soundfield; and rendering the sound source of the received sound signals to a surround sound format to simulate the determined spatial content of the soundfield surrounding the listening location, wherein rendering includes placing a virtual sound source according to the determined direction of arrival of the sound source within the range of at least 180 degrees of values of direction defined by the soundfield, and wherein rendering includes determining respective different signals to be provided to at least two different speakers.

2. A method according to claim 1, wherein the two or more microphones are affixed on the exterior of a helmet.

3. A method according to claim 1, further comprising broadcasting a signal having the surround sound format.

4. A method according to claim 3, wherein the surround sound format is a 5.1 surround sound format.

5. A method according to claim 2, wherein extracting includes processing the received sound signals to determine the direction of arrival at the helmet from the sound source.

6. A method according to claim 1, further comprising receiving positioning information corresponding to locations of the two or more microphones.

7. A method according to claim 6, wherein the positioning information includes one or more of inputs from an accelerometer, a gyroscope or a compass.

8. A method according to claim 1, further comprising transmitting the received sound signals to a remote location, wherein the extracting and rendering are performed at the remote location.

9. A method according to claim 2, further comprising transmitting the received sound signals to a remote location from the helmet, wherein the extracting and rendering are performed at the remote location.

10. A method according to claim 8, wherein transmitting is performed using one or more of WiFi or Bluetooth.

11. A method according to claim 9, wherein transmitting is performed using one or more of WiFi or Bluetooth.

12. A method according to claim 1, further comprising performing noise cancellation on the received sound signals.

13. A method according to claim 1, wherein the two or more microphones are affixed on a hat.

14. A method according to claim 1, wherein the two or more microphones are affixed on an airborne camera.

15. A method according to claim 1, wherein the two or more microphones are affixed on a stadium fixture.

16. A method according to claim 2, wherein a loudspeaker configuration of the surround sound format to which the sound source of the received sound signals is rendered is different than a configuration of the two or more microphones.

17. A method according to claim 16, wherein the determined direction of arrival is independent of the configuration of the two or more microphones on the helmet and the loudspeaker configuration.

* * * * *